United States Patent [19]

Vigluicci et al.

[11] 3,948,550

[45] Apr. 6, 1976

[54] DOOR LATCH

[76] Inventors: Kenneth Vigluicci, 103 Crest Road; Joseph Reiner, 30 Sutton Place, both of Toms River, N.J. 08753

[22] Filed: Oct. 3, 1974

[21] Appl. No.: 511,542

[52] U.S. Cl. ..... 292/137; 292/2; 292/11; 292/346

[51] Int. Cl.[2] ..... E05C 7/00; E05C 19/00

[58] Field of Search ..... 292/137, 2, 11, 346

[56] References Cited

UNITED STATES PATENTS

| | | | |
|---|---|---|---|
| 359,183 | 3/1887 | Sherwood | 292/346 |
| 1,194,636 | 8/1916 | Joy | 292/137 |
| 1,471,061 | 10/1923 | Reineman | 292/2 |
| 1,528,689 | 3/1925 | Phillips | 292/346 |
| 1,993,659 | 3/1935 | Goodman et al. | 292/11 |
| 2,028,954 | 1/1936 | Roedding | 292/2 |
| 2,492,322 | 12/1949 | Russell | 292/346 |
| 2,830,837 | 4/1958 | Falk | 292/11 |
| 2,841,430 | 7/1958 | Krause | 292/11 |

*Primary Examiner*—Robert L. Wolfe
*Assistant Examiner*—Victor N. Sakran
*Attorney, Agent, or Firm*—Allison C. Collard

[57] ABSTRACT

A latch for use with a door knob lock for contact with a corresponding opening formed in a door jamb consisting of a bolt having a beveled surface along its closing edge and including a slot defined by a first side wall substantially perpendicular to the axis of the bolt and formed adjacent to the edge of the door, a second spaced-apart wall formed within the bolt and within the door jamb recess and a base surface interconnecting the two walls together. The intersection between the second wall and the base surface preferably defines a notch having an acute angle. The base surface is preferably inclined with respect to the axis of the bolt so that its intersection with the first wall forms an acute angle. The slot formed in the bolt is capable of catching any flat instrument which is inserted between the door and the door jamb to prevent unauthorized entry.

1 Claim, 3 Drawing Figures

DOOR LATCH

This invention relates to an improved latch bolt for a door lock which prevents unauthorized entry.

More specifically, this invention relates to an improved latch bolt on a door lock having an inclined notch so that when a flat instrument is inserted between the door and the jamb, against the beveled edge of the bolt, the notch grips the edge of the flat instrument preventing the bolt from opening.

In conventional door locks having a standard bolt with a beveled edge, it is often possible to gain entry through the locked door by inserting flat instruments, such as a plastic credit card against the bolt so that the bolt can be urged out of the door jamb. In order to prevent this type of entry, it is common to employ a second lock such as a dead bolt lock in conjunction with the standard door lock, a procedure which involves additional expense.

In the present invention, the latch bolt of the door lock includes an inclined slot which is formed at the end of the beveled surface adjacent to its opening between the door and the door jamb. If a flat instrument such as a credit card is inserted and contacts the bolt, the flat instrument enters the inclined slot and provides an additional force to push the latch bolt closed. In an earlier U.S. Pat. No. 1,471,061, a latch bolt is disclosed having only a thin transverse slot of narrow width. When flat instruments such as credit cards are inserted, it is possible to bend the card toward the beveled surface of the latch bolt so as to avoid the narrow slot and force the bolt open. The present invention represents a substantial improvement over the prior art in providing a latch bolt having an expanded slot with an inclined surface so that it is impossible for the credit card to contact the beveled surface of the latch bolt. Moreover, the forward thrust of the flat instrument is used to urge the latch bolt further into its closed position.

It is therefore an object according to the present invention to provide an improved latch bolt having a slot for preventing illegal entry by a flat instrument.

It is another object according to the present invention to provide a latch bolt which is simple in design, easy to manufacture and reliable in operation.

Other objects and features of the present invention will become apparent from the following detailed description considered in connection with the accompanying drawing which discloses the embodiment of the invention. It is to be understood however that the drawing is designed for the purpose of illustration only and not as a definition of the limits of the invention.

In the drawing wherein similar reference characters denote similar elements throughout the several views.

Figure 1:
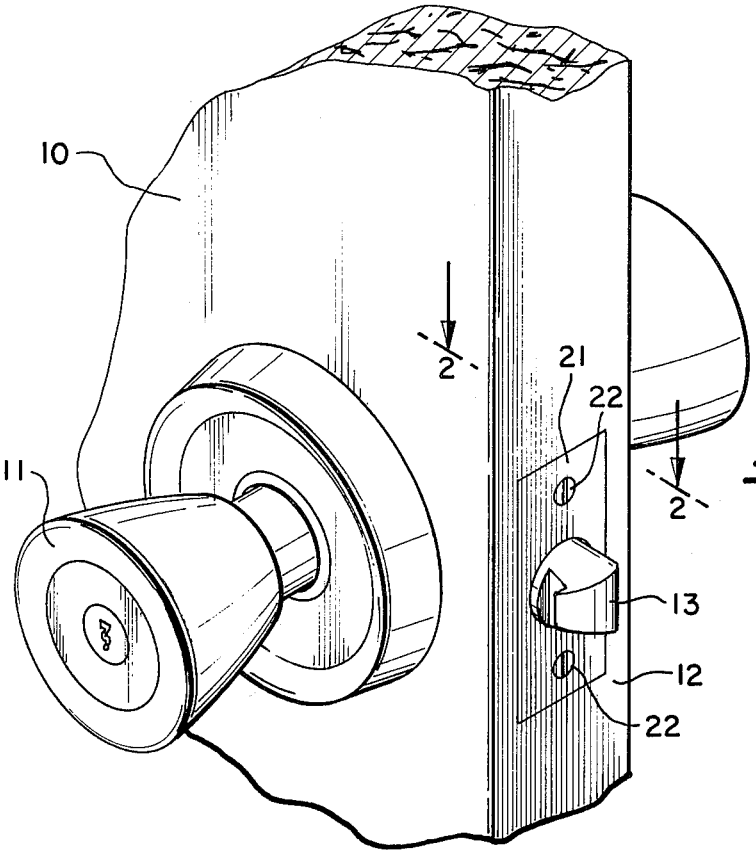
FIG. 1 is a perspective view showing the improved latch bolt installed in a standard door.
Figure 2:
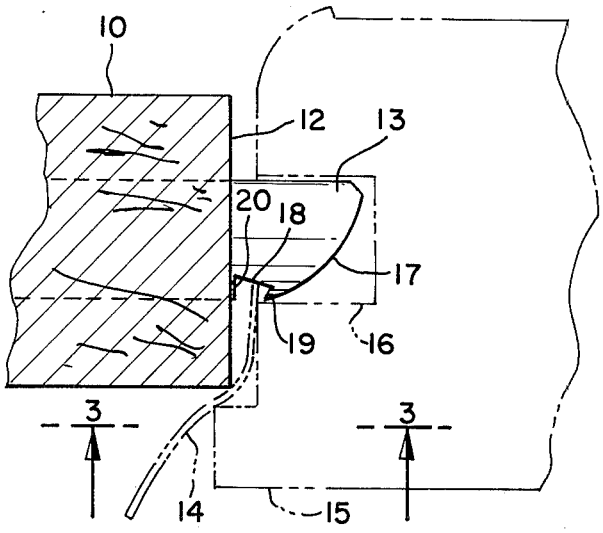
FIG. 2 is a cross sectional view taken along section 2—2 of FIG. 1.
Figure 3:
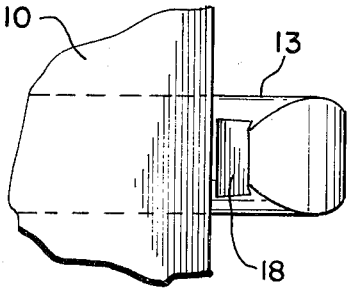
FIG. 3 is a cross sectional view taken along section 3—3 of FIG. 2.

Referring to FIGS. 1–3 there is shown a door 10 having a door knob lock 11 installed therein, and including a projecting latch bolt 13 along an edge 12 of the door. Latch bolt 13 is held in place by means of installation plate 21 and screws 22. The latch bolt has a catch (not shown) on its opposite end which connects to the door handle mechanism so that the bolt can be retracted.

Bolt 13 is designed to fit into a rectangular shaped opening 16 formed in door jamb 15. When the door is closed, the beveled portion 17 of bolt 13 contacts a striker plate (not shown) on the door jamb so that the bolt will be retracted into the door until it is received within opening 16. On the leading edge of the latch bolt adjacent to its beveled surface 17 is formed a slot having one side wall 20 which is substantially perpendicular to the axis of the bolt, and a second side wall 19 which is formed at an acute angle with respect to wall 20. A base surface 18 which is also inclined with respect to the axis of the bolt connects side walls 19 and 20. Side wall 20 is preferably located substantially flush with the edge 12 of door 10. Side wall 19 of the slot is preferably located within opening 16 of the door jamb at the beginning of the beveled surface 17. It can be appreciated that the width of the slot will be sufficient to accommodate a larger gap between the door and the door jamb than normal so that when a flat instrument 14 is inserted between the door and the door jamb, it will be received within the slot formed in the latch bolt.

As shown in detail in FIG. 2, flat instrument 14 engages incline surface 18 of the slot so that there is a component of force directed along the axis of the bolt in the direction of door jamb opening 16. This component of force maintains the latch bolt within the door jamb opening rather than urging it back into the door. If the flat instrument is constructed of flexible plastic and sufficiently resilient, there will be a tendency for the edge of the instrument to contact inclined side wall 19 of the slot. The side wall is notched so as to catch the edge of the flat instrument and prevent it from contacting beveled surface 17 within door jamb opening 16.

The latch bolt of the present invention is generally manufactured along with its installation plate as a separate unit apart from the mechanism of the door knob lock 11. Therefore, it is possible to remove conventional latch bolts without replacing the door knob lock and install the applicant's improved bolt without much additional expense. This removes the necessity of having to install a second lock at a much greater expense to prevent unauthorized entry.

While only a single embodiment of the present invention has been shown and described, it will be obvious that many changes and modifications may be made thereunto without departing from the spirit and scope of the invention.

What is claimed is:

1. A latch for use with a door knob lock for contact with a corresponding opening formed in a door jamb comprising:

a bolt having a free end and a beveled surface thereat along its closing edge, and including a slot defined by a first side wall substantially perpendicular to the axis of the bolt and formed adjacent to the edge of the door, a second spaced-apart wall having a length substantially smaller than the length of said first side wall formed within the bolt and within the door jamb recess, and a base surface interconnecting the walls together, the width of said slot being greater than a gap between the door and the door jamb, the intersection of said base surface with said second wall forms a notch having an acute angle, said base surface is inclined with respect to the axis of said bolt in a direction widening towards said free end, so that upon insertion of a flat instrument into said slot on said base surface, said bolt is biased in a locking direction toward its free end securely into the door jamb, and its intersection with said first wall forms an acute angle.

* * * * *